United States Patent [19]

Wheeler

[11] 4,136,147

[45] Jan. 23, 1979

[54] METHOD OF APPLYING FIRE-PROOFING MATERIAL TO ELONGATE STRUCTURAL MEMBER

[75] Inventor: John P. Wheeler, St. Louis, Mo.

[73] Assignee: Carboline Company, St. Louis, Mo.

[21] Appl. No.: 791,729

[22] Filed: Apr. 28, 1977

[51] Int. Cl.[2] ..... B32B 31/06

[52] U.S. Cl. ..... 264/261; 52/515; 52/727; 264/263; 264/269; 264/277; 425/458

[58] Field of Search ..... 427/277, 278, 300, 355, 427/356; 425/87, 458; 15/235.3, 235.4, 235.5, 235.6, 235.7, 235.8; 52/371, 727, 515; 264/261, 263, 269, 277

[56] References Cited

U.S. PATENT DOCUMENTS

| | | | |
|---|---|---|---|
| 772,597 | 10/1904 | Williamson | 404/97 |
| 1,762,254 | 6/1930 | Zarba | 52/371 |

*Primary Examiner*—Ronald H. Smith
*Assistant Examiner*—Evan K. Lawrence

[57] ABSTRACT

The method of applying a coating of a desired uniform thickness of a spreadable material, such as a cementitious fire-proofing material, to an elongate structural member (e.g., an I-beam) comprises applying a plurality of preformed spacers to the beam, the spacers being of a material compatible with the fire-proofing material and being spaced at intervals along the length of the beam. A pair of spaced guide bars are removably secured to the beam with the guide bars extending lengthwise of the beam and being generally parallel to one another. The guide bars are supported by the spacers so as to be spaced from the beam and each of the guide bars has a guide surface thereon. The spreadable fire-proofing material is applied to the beam in a quantity somewhat greater than is needed to provide the coating of desired uniform thickness and then a tool, such as a darby, is run along the guide surfaces of the guide bars to strike off the spreadable material to form the coating of the desired uniform thickness, to cause the spreadable material to flow into the spaces between the beam and the guide bars as the tool strikes off the spreadable material, and to cause the spreadable material to flow at least partially around the spacers. Finally, the guide bars are removed from the beam.

The tool especially adapted for use with the method of this invention is also disclosed.

3 Claims, 4 Drawing Figures

METHOD OF APPLYING FIRE-PROOFING MATERIAL TO ELONGATE STRUCTURAL MEMBER

BACKGROUND OF THE INVENTION

This invention relates to a method of simultaneously applying a coating of uniform thicknesses to two or more surfaces of a structural member, such as an I-beam or the like. More particularly, this invention is concerned with a method of for applying a uniform layer of a spreadable, hardenable-in-place fire-proofing or thermal protection material to a structural beam or the like of a building or other structure.

Many cities and states require that the structural members in larger buildings and other structures have a fire resistant thermal coating applied thereto to prevent or delay weakening of the member in the event of a fire and to thus preserve the structural integrity of the building. Several suitable fire barrier materials are commercially available, but this invention particularly concerns itself with the method of and apparatus for applying cementitious, hardenable-in-place fire-proofing materials, such as are commercially available from the assignee of this invention, the Carboline Company of St. Louis, Missouri, under their registered trademark PYROCRETE 102. It will be understood that other fire-proofing materials, such as concrete or gunite may also be applied by the method of and apparatus for this invention. Generally, these cementitious fire-proofing materials are spreadable on surfaces of a structural member to be protected and are allowed to harden or cure so as to form a plasterlike coating on the member. In the event of a fire, PYROCRETE 102 fire-proofing material undergoes a thermohydrogenation reaction during which water vapor is released thus enhancing the thermal protection to the member. The thickness of the fire-proofing coating is critical because if a specified minimum thickness is not maintained, even over a small area of the member, insufficient thermal protection will be afforded to the member and the overall fire rating of the beam may be markedly decreased. If excess material is applied, waste of the fire-proofing material will result.

Heretofore, fire-proofing material was either sprayed or manually spread (e.g., trowelled) onto the surfaces of the beam (or other member). Measurements were frequently taken by means of inserting a probe into the freshly applied fire-proofing material so as to insure that the desired thickness was applied. In instances where a more uniform and aesthetically pleasing appearance was desired, manual trowelling rather than spraying of the material onto the surfaces was required. The speed at at which the fire-proofing material could be applied and the uniformity of the finish was dependent upon the skill of the workman trowelling the material onto the beam. In applying the spreadable fire-proofing material to vertical columns and structural beams, it was sometimes difficult for a workman to gain access to all surfaces of the members for the purpose of manually trowelling the fire-proofing material thereon.

Other methods of applying fire-proofing coating to beam surfaces are known in which form boards sized to the thickness of the coating to be applied were secured to the flange edges of an I-beam. Excess material was then applied to the beam surfaces and a screed or other tool was run along the edges of the form boards to strike off excess material from one surface of the beam in much the same manner as a screed in run along a concrete form to strike excess concrete. Other surfaces of the beam were then similarly finished and the form boards were then removed. Additional insulation material was added to fill in the spaces vacated by the form boards. This prior screed method, however, required that the form boards be accurately sized to the thickness of the material to be applied, and to the dimensions of the beam. This method did not allow multiple surfaces of the beam to be simultaneously finished and the finishing of the inner flange and web surfaces of the beam was still essentially a manual trowelling operation.

SUMMARY OF THE INVENTION

Among the several objects of this invention may be noted the provision of a method of simultaneously applying a coating of spreadable fire-proofing material or the like to multiple surfaces of a structural member, such as an I-beam; the provision of such a method which results in the application of a fire-proofing coating of uniform thickness and smooth appearance; the provision of such a method in which the edges of the flange of the beam are coated simultaneously with the flange and web faces; and the provision of such a method which speeds application of fire-proofing material and which does not require special training or skills to employ.

Briefly, the method of this invention relates to applying a coating of desired uniform thickness of a spreadable material, such as a cementitious fire-proofing material, to an elongate member, such as to a structural beam or the like, with the spreadable material being hardenable-in-place on the member. The method comprises the steps of applying a plurality of preformed spacers to the member, the spacers being compatible with the spreadable material and being spaced at intervals along the length of the member. A pair of spaced guide bars are then removably secured to the member with the guide bars extending lengthwise of the member and being generally parallel to one another, and with the guide bars being supported by the spacers so as to be spaced from the member. Each of the guide bars has a surface constituting a guide surface. The spreadable material is then applied to the surfaces of the member to be coated in a quantity somewhat greater than is needed to provide the coating of desired uniform thickness on the member. A tool, such as a darby or the like, is run along the guide surfaces of the guide bars to strike off the spreadable material, to form the coating of desired uniform thickness on the member, to cause the spreadable material to flow into the spaces between the member and the guide bars as the tool strikes off the spreadable material, and to cause the spreadable material to at least partially flow around the spacers. The guide bars are then removed from the member.

The tool comprises first and second screed members which constitute a screed for striking off spreadable material applied to the beam surfaces in excess quantity. Means is provided for adjustably securing the screed members together. The screed has a lower edge adapted to strike off the excess material from the web surface of the beam and at least one side edge generally perpendicular to its lower edge for striking off excess material from a respective inner flange surface of the beam. The tool further includes guide means on opposite sides of the screed, these guide means being engageable with guide surfaces on the beam for holding the lower edge of the screed in a predetermined distance from the web face and for maintaining the side edge of the screed a predetermined distance from the inner flange surface of the beam corresponding to the thickness of the coating to be applied to the inner flange face of the beam as the tool is moved along the beam.

Other objects and features of this invention will be in part apparent and in part pointed out hereinafter.

BRIEF DESCRIPTION OF THE DRAWINGS

Corresponding reference characters indicate corresponding parts throughout several views of the drawings.

DESCRIPTION OF PREFERRED EMBODIMENTS

Figure 1:
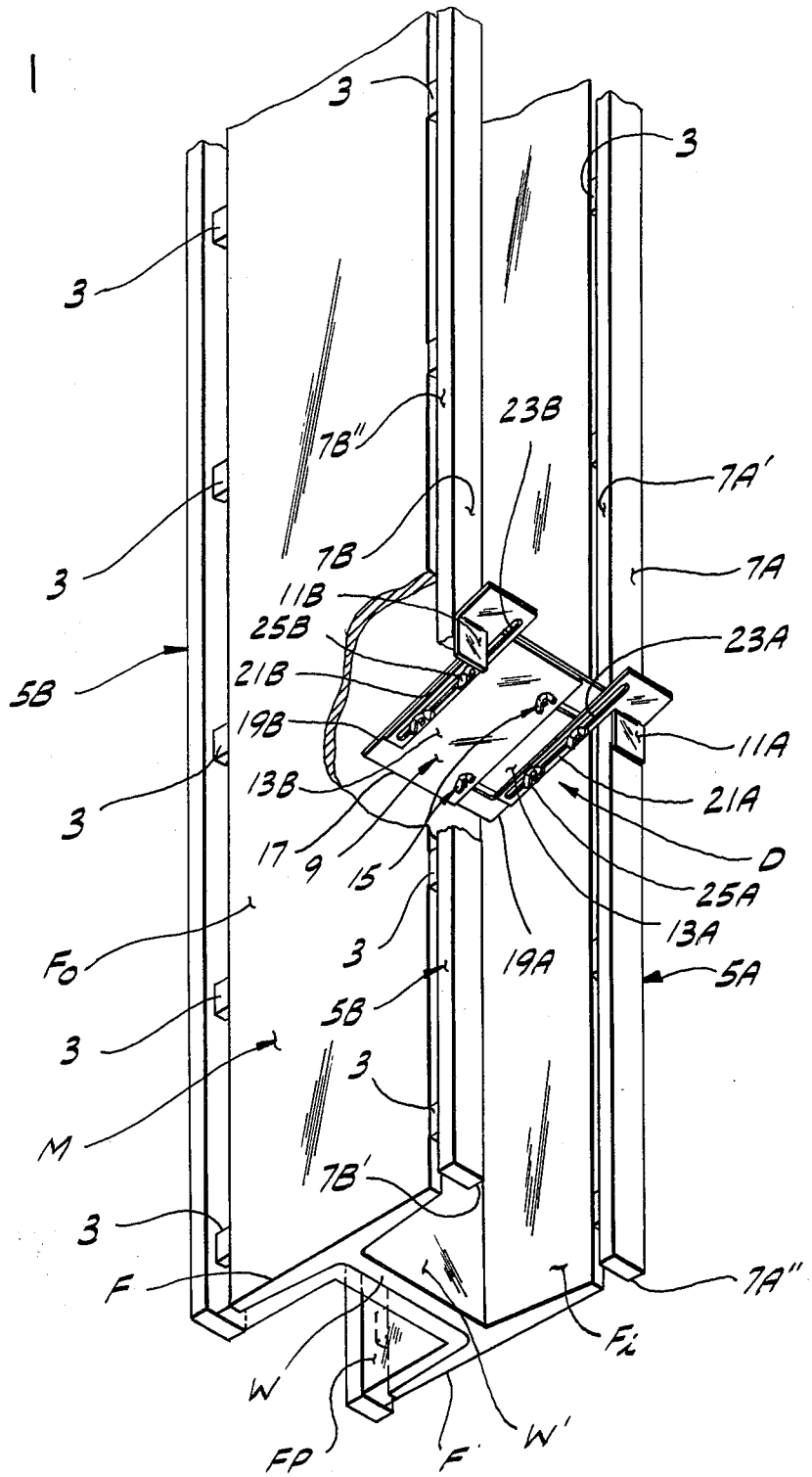
FIG. 1 is a perspective view of a structural wide-flange member or I-beam illustrating the method of this invention for simultaneously applying a coating of uniform thickness of a spreadable material, such as a cementitious fire-proofing material, to multiple surfaces of the beam.

Referring now to the drawings, the method of this invention is shown to relate to the application of a spreadable material FP, such as a cememtitious fire-proofing or thermal protection material, applied to a structural member M of a building or other structure. The fire-proofing material referred to is preferably a fire-proofing material commercially available from the assignee of this invention, The Carboline Company of St. Louis, Missouri, under their registered trademark PYROCRETE 102. It will be understood, however, that other suitable spreadable, hardenable-in-place materials, such as concrete, gunite, or other cement or plaster-like materials, and that still other spreadable, non-hardenable materials, such as adhesives and mastics, may be applied in accordance with the method and apparatus of this invention.

As shown in the drawings, structural member M is a wide flange member or I-beam having a web W and flanges F. The beam has web faces W' and inner and outer flange surfaces $F_i$ and $F_o$, respectively. It will be understood, however, that structural members of other shapes (e.g., angles, channels and the like) may have fire-proofing material applied thereto in accordance with the method of this invention, as will be readily understood from the description hereinafter.

As illustrated in the drawings, the method of this invention involves securing (e.g., clamping or bonding) a plurality of preformed spacers 3 to the edges of the flanges F of structural members M. These spacers are preferably made of cured PYROCRETE 102 fire-proofing material or other material which is compatible with the fire-proofing material, and are of a predetermined height generally equal to the thickness of the coating to be applied to the flange edges. The spacers are clamped or bonded to the beam flange edges at spaced intervals therealong (for example, about every 12 inches or 30 cm.). A respective guide bar 5A, 5B is removably secured to each row of spacers 3. Each guide bar is preferably a strip of wood or the like and is removably secured (e.g., clamped), on the outer ends (outer sides) of the spacers. Each guide bar has a respective guide surface 7A, 7B generally parallel to web face W' for purposes as will appear.

Figure 3:
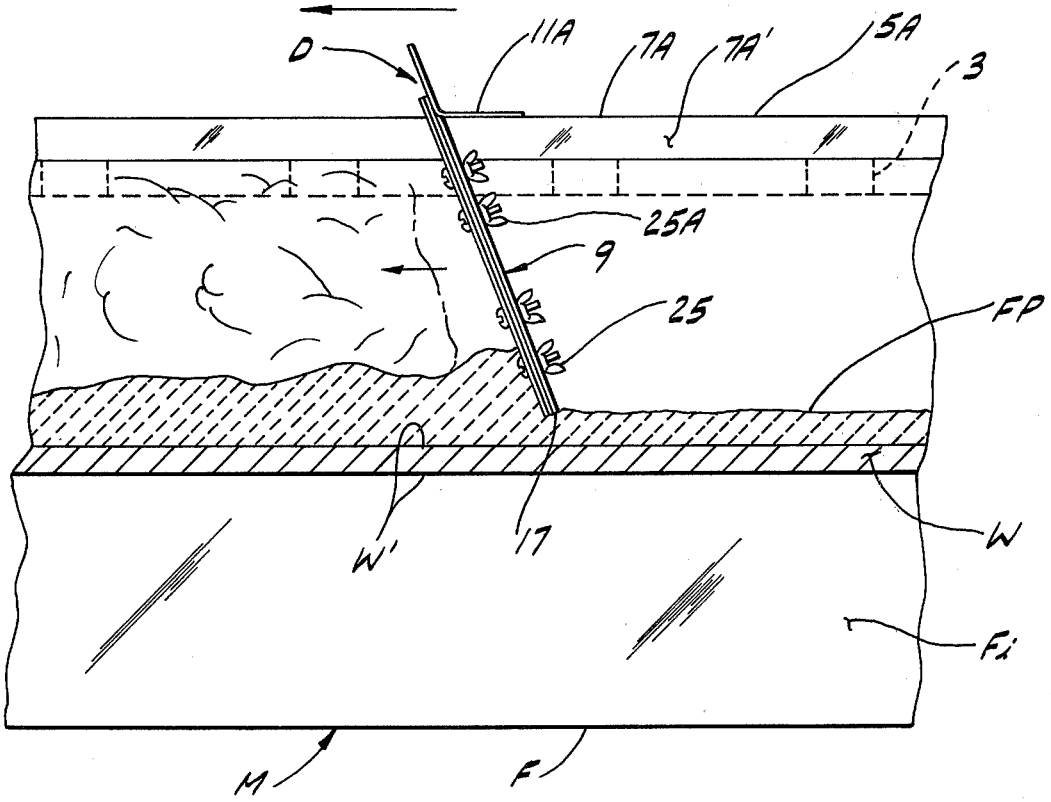
FIG. 3 is a longitudinal cross-sectional view of the beam.
Figure 4:
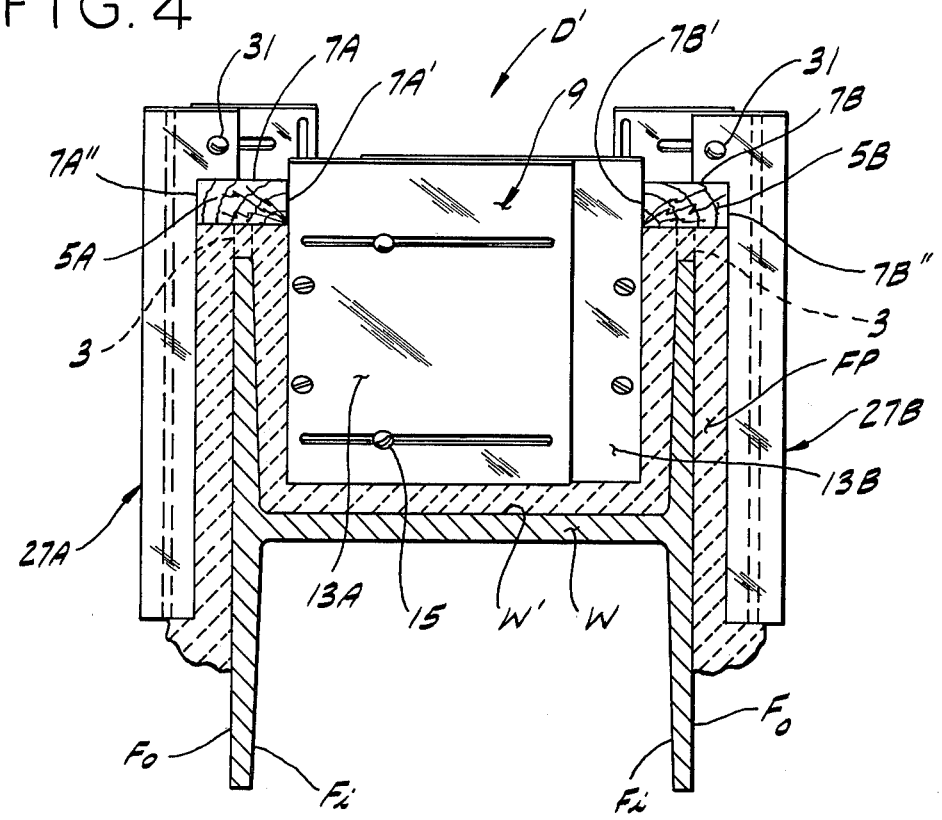
FIG. 4 is a view similar to FIG. 2 illustrating another embodiment of the method of this invention for simultaneously applying spreadable material to both the inner and outer flange surfaces of a beam.

Further in accordance with the method of this invention, spreadable fire-proofing material is applied to the surfaces of the beam M to be coated. This may be accomplished by manually trowelling an excess amount of spreadable fire-proofing material FP onto the beam surfaces to be coated. It will be noted, however, that undue care need not be taken to uniformly apply the material to a desired thickness, but only that the material be applied to the beam surfaces in a quantity sufficient to provide a coating generally in excess of the desired uniform thickness to be applied to the beam surfaces. As is shown in the drawings, the beam surfaces which are to be protected may include one or both inner flange surfaces $F_i$ and the web face W' (as shown in FIGS. 1–3), or the abovementioned beam surfaces along with the outer flange faces $F_o$ (as shown in FIG. 4).

Further in accordance with this method, a tool, such as a darby D of this invention (as will be hereinafter described) is run along guide surfaces 7A, 7B of guide bars 5A, 5B to strike off excess fire-proofing material FP applied to the beam surfaces to be coated to thus form the coating layers of desired uniform thickness. The thickness of this coating is established by certain edges on the darby and by the location of the above-noted guide surfaces in relation to the beam surfaces to be coated in a manner as will hereinafter be described. As can be best seen in FIG. 3, excess material is carried along the front of the tool as the tool is run along the guide bars. This excess material flows into the low spots in the material previously applied to the beam surfaces and strikes off the high spots of the material to thus result in a coating of the desired uniform thickness. At the outer edges of the beam flanges F, the spreadable material flows into the spaces between spacers 3 and the inner faces of the guide bars 5A, 5B to at least partially surround the spacers. After striking off the material, the guide bars are removed from the spacers and the material is permitted to harden. Alternatively, guide bars 5A, 5B may be removed after the material has been hardened. If upon removal of the guide bars it is seen that sufficient material did not flow around spacers 3 so as to completely surround them with fire-proofing material, additional fire-proofing material may be manually applied to the edges of the beam flanges so as to build up the thickness of the material on the flange edges to the desired thickness, as established by the height or thickness of the spacers. Because the spacers are made of fireproofing material FP (or a material compatible with the fire-proofing material) no voids or other discontinuities in the fire-proofing material are present.

Figure 2:
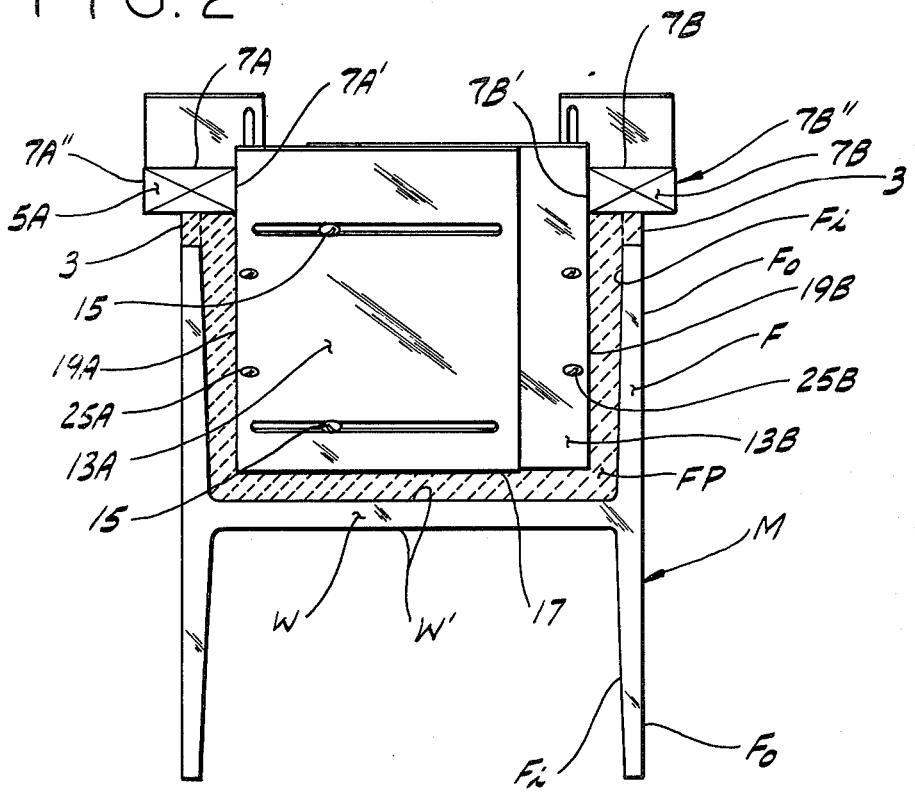
FIG. 2 is a transverse cross-sectional view of the beam.

As is best shown in FIG. 2, guide bars 5A, 5B each have the previously mentioned guide surfaces 7A, 7B and other guide surfaces 7A', 7B' which are generally parallel inner flange face $F_i$ and which face inwardly toward one another. Thus, the heretofore discussed guide surfaces 7A, 7B constitute first guide surfaces which face generally outwardly away from the beam web face for establishing the thickness of the layer of coating FP to be applied to the web face W'. The inwardly facing guide surfaces 7A', 7B' constitute other reference surfaces (also referred to as second guide surfaces) for establishing the thickness of the layers of coating FP to be applied to the inner flange faces $F_i$ of the beam flanges. The guide bars each include a third reference surface 7A", 7B", respectively which is generally parallel to its respective guide surface 7A', 7B' for purposes as will appear.

Tool D of this invention is shown to comprise a darby having an adjustable screed 9 and guide means constituted by feet 11A, 11B on either side of the screed adapted to slidingly engage the outwardly facing guide surfaces 7A, 7B of guide bars 5A, 5B. Screed 9 is adapted to extend in between the bars 5A and 5B and the flanges F and comprises two overlapping screed plates 13A, 13B adjustably secured together by screw and slot fastening arrangements, as generally indicated at 15, so that the screed plates may be moved widthwise relative to one another thereby to vary the width of the screed. Screw and slot arrangements 15 may be loosened to permit relative sliding of the screed plates and may be tightened to lock the screed plates at any selected screed width within their range of adjustment. The screed has a bottom or lower (inner) edge 17 distal from feet 11A, 11B which constitutes a screed edge for forming the outer surface of the layer of coating FP applied to web face W' of the beam. The screed has parallel side edges 19A, 19B on opposite sides of the screed. These side edges constitute screed surfaces for forming the outer surfaces of the coating applied to the inner flange faces $F_i$ of the beam flanges. As shown in the drawings, screed side edges 19A, 19B are adjusted to simultaneously strike off the spreadable material from both of inner flange faces, but it will be understood that in accordance with this invention the screed need only have one of the above-mentioned screed side surfaces thereby to simultaneously strike off excess material FP from a respective inner flange face $F_i$ simultaneously with screed edge 17 striking excess material from web face W' as the two are moved along the beam.

Each of the above-mentioned guide feet 11A, 11B has a respective depending leg 21A, 21B with each foot being angled with respect to its respective leg. Each of these legs has a respectively elongate slot 23A, 23B therein with the outer edge of each leg being generally in line with an adjacent side screed edge 19A, 19B. Screws 25A, 25B are releasably carried by each of the screed plates and are received within a respective slot 21A, 21B so that upon tightening the screws, the legs are clamped relative to their respective screed plates. It will be appreciated that by loosening and tightening screw and slot arrangement 15 and screws 25A, 25B, both the width and the depth of the screed may be adjusted to accommodate any beam size within a predetermined range of dimensions and any thickness of the coating FP to be applied to the web surface W' and to each of the inner flange faces $F_i$ of the beam.

As heretofore mentioned and as is best illustrated in FIG. 3, guide feet 11A, 11B are angled relative to their respective depending legs 21A, 21B so that the legs and screed 9 angle downwardly and rearwardly relative to the direction of movement of the tool along the guide bars 5A, 5B (as shown by the arrow in FIG. 3). Thus, the lower (inner) edge 17 of the screed trails the upper portion of the screed to uniformly strike off the excess material applied to web W'. As shown in FIG. 2, inwardly facing guide surfaces 7A', 7B' of guide bars 5A, 5B, respectively, hold screed 9 substantially centered therebetween so that spaces between the side screed edges 19A, 19B and the inner flange faces $F_i$ correspond to the thickness of the fire-proofing material FP to be applied to the inner flange faces.

A variation used in the tool of this invention is indicated at D' in FIG. 4. This second embodiment of the tool is essentially identical to the darby heretofore described but for the provision of secondary screed members 27A, 27B which extend down from respective guide feet 11A, 11B on the outside of the beam flanges F. Each of these secondary screed members is a relatively stiff member having a respective side edge 29A, 29B adjacent a respective outer flange face $F_o$ of the beam and being spaced from the outer flange faces of the beam a distance corresponding to the thickness of the layer of fire-proofing material to be applied to these outer flange faces $F_o$. Screed members 27A, 27B are adjustably secured to their respective feet 11A, 11B by means of adjustable screw and slot arrangements 31 to thus permit adjustment of the auxiliary screeds toward and away from the outer flange faces of the beam so as to vary the thickness of the coating FP applied thereto. These auxiliary screeds may also be telescopically adjustable so as to accommodate various beam flange widths.

In accordance with the method of this invention, a coating of a desired uniform thickness can be applied to the outer faces $F_o$ of beam flanges F simultaneously with striking off and finishing the coating applied to the web and inner flange faces W' and $F_i$ by spreading fire-proofing material FP or the like on all surfaces of the beam to be coated, and by running the tool D' of this invention along guide bars 5A, 5B so that the screed 9 and the auxiliary outside screed members 27A, 27B moving along guide bar surfaces 7A" and 7B" simultaneously strike excess material from the web face and from the inner and outer flange faces $F_i$ and $F_o$.

In view of the above, it will be seen that the several objects of the invention are achieved and other advantages results attained.

As various changes could be made in the above constructions without departing from the scope of the invention, it is intended that all matter contained in the above description or shown in the accompanying drainings shall be interpreted as illustrative and not in a limiting sense.

What is claimed is:

1. The method of applying a coating of a spreadable, cementitious fire-proofing material to an elongate structural member of uniform cross section throughout its length having a web and a pair of flanges perpendicular to the web extending parallel to one another from one face of the web and facing one another, with the coating spread in a layer of generally uniform thickness on said one face of the web, in a layer of generally uniform thickness on the inside face of at least one of the flanges adjacent said one face of the web, and on the edge of said one flange adjacent its said inside face, said method comprising the steps of:

securing a plurality of preformed spacers to the said edges of said flanges, said spacers being of a material compatible with said fire-proofing material, and being secured in a row at spaced intervals along each of said edges, said spacers being of generally equal thickness corresponding to a desired thickness for the layer of material on the said edge;

removably securing a pair of guide bars in position overlying the spacers on the said edges of each of the flanges, with each of said bars extending along a said row of spacers and spaced thereby from the edge of the respective flange a distance corresponding to the said desired thickness for the layer on the said edge, the surface of each bar facing generally outwardly away from the respective flange edge and generally parallel to the said one web face constituting a first guide surface for a spreading tool to establish in conjunction with the tool the thickness of the layer to be spread on the said one face of said web, and the opposed facing surfaces of said bars generally parallel to the inner flange faces constituting second guide surfaces for the tool, at least one of said second guide surfaces being spaced from the inside face of its respective flange a distance required to establish in conjunction with the tool the thickness of the layer to be spread on the inside face of said one flange;

applying said spreadable fire-proofing material to said one face of the web and the inside face of said one flange in a quantity in excess of that needed to provide the desired thickness for the said layers thereon;

running said tool along the bars, said tool having guide means engageable with said first guide surfaces of said bars and a screed which extends in between the bars and the flanges and has parallel side edges movable along the said second guide surfaces of the bars and an inner edge perpendicular to the side edges and spaced from said one face of the web, so that the inner edge of the screed strikes off the material on the said one face of the web to form the layer of generally uniform thickness on the web, so that one said side edge of the screed strikes off the material on the inside face of said one flange to form the layer of generally uniform thickness on said inside face, and so that excess material is forced to flow into the spaces between the edge of the said one flange and the guide bar thereon and between the spacers on said one flange to at least partially flow around the spacers to fill said spaces; and removing said guide bars after running said tool.

2. The method of applying a coating of a spreadable, cementitious fire-proofing material to an elongate structural member such as an I-beam of uniform cross section throughout its length having a web and flanges extending out from both sides of the web, the flanges being perpendicular to the web, extending parallel to one another and facing one another on both sides of the web, with the coating spread in a layer of generally uniform thickness on one face of the web, in a layer of generally uniform thickness on the inside face of each of the flanges adjacent said one face of the web, and on the edge of each flange adjacent its said inside face, said method comprising the steps of:

securing a plurality of preformed spacers to the said edges of said flanges, said spacers being of a material compatible with said fire-proofing material, and being secured in a row at spaced intervals along each of said edges, said spacers being of generally equal thickness corresponding to a desired thickness for the layers of material on the said edges; removably securing a pair of guide bars in position overlying the spacers on the said edges of each of the flanges, with each of said bars extending along a said row of spacers and spaced thereby from the edge of the respective flange a distance corresponding to the said desired thickness for the layer on the said edge, the surface of each bar facing generally outwardly away from the respective flange edge and generally parallel to the said one web face constituting a first guide surface for a spreading tool to establish in conjunction with the tool the thickness of the layer to be spread on the said one face of said web, and the opposed facing surfaces of said bars generally parallel to the inner flange faces constituting second guide surfaces for the tool, said second guide surfaces being spaced inwardly from the inside faces of the flanges a distance required to establish in conjunction with the tool the thickness of the layers to be spread on the inside faces of the flanges;

applying said spreadable fire-proofing material to said one face of the web and the inside faces of the flanges in a quantity in excess of that needed to provide the desired thickness for the said layers thereon; running said tool along the bars, said tool having guide means engageable with said first guide surfaces of said bars and a screed which extends in between the bars and the flanges and has parallel side edges movable along the said second guide surfaces of said bars and an inner edge perpendicular to the side edges and spaced from said one face of the web, so that the inner edge of the screed strikes off the material on the said one face of the web to form the layer of generally uniform thickness on the web, so that the said side edges of the screed strike off the material on the inside faces of the flanges to form the layers of generally uniform thickness on said inside faces, and so that excess material is forced to flow into the spaces between the edges of the flanges and the guide bars thereon and between the spacers on the flanges to at least partially flow around the spacers to fill said spaces; and removing said guide bars after running the tool.

3. The method of claim 2 wherein each of said guide bars has a third guide surface generally parallel to its second guide surface, and wherein the tool is provided with additional screeds on the outside of said flanges, said screeds having inner edges extending parallel to and spaced from the outer faces of the flanges a distance corresponding to a desired thickness for layers of said material to be applied to the outer faces of the flanges, each of said inner edges of said additional screeds being movable along said third guide surfaces; said method further comprising applying said fire-proofing material to the outer faces of the flanges in a quantity in excess of that needed to provide a layer of desired thickness thereon, whereupon said running of the tool results in striking off the material on the outer faces of the flanges with said additional screeds simultaneously with striking off the material from the said one face of the web and inside faces of the flanges.

* * * * *